US006994409B2

(12) United States Patent
Godlewski

(10) Patent No.: US 6,994,409 B2
(45) Date of Patent: Feb. 7, 2006

(54) CONTROLLED ACCESS DISPENSING SYSTEM

(75) Inventor: Peter Godlewski, San Clemente, CA (US)

(73) Assignee: Dispensesource, Inc., Rancho Santa Margarita, CA (US)

( * ) Notice: Subject to any disclaimer, the term of this patent is extended or adjusted under 35 U.S.C. 154(b) by 127 days.

(21) Appl. No.: 10/188,734

(22) Filed: Jul. 2, 2002

(65) Prior Publication Data

US 2004/0004419 A1 Jan. 8, 2004

(51) Int. Cl.
*E06B 9/15* (2006.01)

(52) U.S. Cl. ..... 312/297; 312/4; 312/291; 312/215

(58) Field of Classification Search ..... 312/297, 312/3, 4, 291, 215, 216, 217, 222; 160/120, 160/122, 241; 150/158, 165
See application file for complete search history.

(56) References Cited

U.S. PATENT DOCUMENTS

| | | | | | |
|---|---|---|---|---|---|
| 105,665 | A | * | 7/1870 | Foss | 160/108 |
| 912,166 | A | * | 2/1909 | Pomeroy | 312/107 |
| 1,730,685 | A | * | 10/1929 | Ramsey | 312/101 |
| 1,857,368 | A | * | 5/1932 | Flynn et al. | 359/450 |
| 1,986,022 | A | * | 1/1935 | Stahl | 312/291 |
| 2,040,634 | A | * | 5/1936 | Sekyra | 62/382 |
| 3,168,364 | A | * | 2/1965 | Schaffer-Sell | 312/297 |
| 4,085,863 | A | | 4/1978 | Johnson | |
| 4,261,480 | A | | 4/1981 | Fuss | |
| 4,267,666 | A | * | 5/1981 | Davidson | 49/63 |
| 4,410,104 | A | | 10/1983 | Carswell et al. | |
| 4,421,364 | A | * | 12/1983 | Takaniemi | 312/35 |
| 4,475,313 | A | * | 10/1984 | Governale | 49/370 |
| 4,804,108 | A | | 2/1989 | Ficken | |
| 4,944,169 | A | * | 7/1990 | Labelle et al. | 70/100 |
| 5,135,136 | A | | 8/1992 | Moone | |
| 5,138,462 | A | * | 8/1992 | Skovgaard | 348/836 |
| 5,501,364 | A | | 3/1996 | Cooper | |
| 5,547,273 | A | | 8/1996 | Hudnall | |
| 5,581,944 | A | * | 12/1996 | Kornbrekke et al. | 49/28 |
| 5,730,316 | A | | 3/1998 | Falk | |
| 5,745,366 | A | | 4/1998 | Godlewski et al. | |
| 6,341,271 | B1 | | 1/2002 | Salvo et al. | |
| 6,418,416 | B1 | | 7/2002 | Rosenberg et al. | |
| 6,450,598 | B1 | * | 9/2002 | Hanel | 312/268 |
| 6,561,250 | B2 | * | 5/2003 | Hutchins | 160/89 |

FOREIGN PATENT DOCUMENTS

| | | | |
|---|---|---|---|
| EP | 0 911 123 A1 | | 4/1999 |
| JP | 2000-152128 | * | 5/2000 |

OTHER PUBLICATIONS

Copy of European Search Report dated Oct. 17, 2003.

* cited by examiner

*Primary Examiner*—Janet M. Wilkens
(74) *Attorney, Agent, or Firm*—Knobbe Martens Olson & Bear LLP

(57) ABSTRACT

A controlled access dispensing unit arranged to permit selective access to supply items within a portion of the dispensing unit. Preferably, the dispensing unit includes a cabinet arranged to hold a plurality of supply items. An enclosure assembly desirably includes a first panel and a second panel positioned in a plane substantially parallel to and aligned with a plane defined by the first panel. The two panels each comprise an opening that together defines a variable size and moveable access opening.

21 Claims, 7 Drawing Sheets

CONTROLLED ACCESS DISPENSING SYSTEM

BACKGROUND OF THE INVENTION

1. Field of the Invention

The present invention generally relates to dispensing systems and dispensing methods. More particularly, the present invention relates to controlled access dispensing systems and related methods especially suited for use in industrial supply applications.

2. Description of the Related Art

In many business environments, the immediate availability of supply items is critical to the overall efficiency of the company. For example, in manufacturing companies, if certain consumable supply items (e.g., drill bits, cutting tools, commonly-replaced spare parts, etc.) are unavailable, production may be entirely shut down until such items may be procured. Accordingly, accurate management of supply item inventory is very important. In addition, controlled access to such supply items is often desirable to ensure that recorded inventory levels are accurate and to ensure that only authorized personnel have access to certain supplies.

As a result, many businesses employ a controlled access inventory system for managing such supply items. One method of controlled access is to locate the supply items within a secure area, commonly referred to as a tool crib, or "crib." These cribs are often centrally located within the business facility and use one or more employees (i.e., a crib attendant) to ensure that only appropriate persons have access to certain supply items. In addition, the crib attendants are often responsible for tracking the usage of the supply items and periodically updating the inventory system.

However, the location of such cribs often makes retrieving supplies inconvenient to a large portion of the users of the supply items, which leads to stockpiling of often-used items. This results in the recorded inventory levels being inaccurate. In addition, the crib system often inefficiently utilizes the time of the crib attendant. Further, as is known, manual inventory control by physical inspection may be unreliable and often results in depletion of certain supply items before a restocking order is generated.

A generally more preferred method of inventory control and tracking is the use of automatic dispensing units located more closely to the actual point of use of the supply items than a traditional crib. Such dispensers often control access of supply items by requiring the user to enter a user identification code and only permitting access to supply items that the employee is authorized to access.

A common supply item dispensing unit is configured with a plurality of compartments having access openings that may be selectively unlocked to permit access to the supply item(s) therein. However, in known dispensing units, the dimensions of the access openings are generally limited to a relatively small number of predetermined sizes. In addition, once the dispensing unit has been installed, it is often prohibitively expensive to reconfigure the sizes of the access opening to accommodate changes in the types and sizes of supply items utilized in the business. Further, the dispensing units are often of a stand-alone design and, therefore, if the benefits of controlled access are desired, require the complete replacement of existing, standard shelving or storage cabinets.

SUMMARY OF THE INVENTION

Accordingly, a need exists for a dispensing system that may be easily configured to accommodate supply items having a wide variety of sizes. In addition, a need exists for a dispensing system that may be reconfigured to accommodate necessary changes in access opening sizes required due to changes in the types and/or sizes of supply items that are stocked. Further, a need exists for a dispensing system that may be utilized with existing, standard shelving or storage cabinets.

An aspect of the present invention involves a controlled access dispensing unit, which includes a cabinet. The cabinet has a plurality of storage spaces sized and shaped to store a plurality of supply items and a substantially open side permitting access to the plurality of storage spaces. An enclosure arrangement encloses the open side of the cabinet and is configured to permit selective access to one or more of the storage spaces. The enclosure has a first panel having a first portion defining a first end surface generally aligned with a first axis. The first panel also has a second portion defining a second end surface generally aligned with the first axis and facing the first surface. The first and second portions have a closed position relative to one another for preventing access to the plurality of storage spaces wherein the first portion is coupled to the second portion. The first and second portions are movable relative to the cabinet in the closed position along a second axis substantially normal to the first axis. In addition, the first and second portions are movable relative to one another to an open position for permitting access to one or more of the plurality of storage spaces. In the open position the first portion is uncoupled with the second portion and the first and second end surfaces are separated from one another in the open position to define a first space therebetween.

Another aspect of the present invention involves a method of controlled dispensing of supply items. The method includes providing supply items within a cabinet and providing a first panel configured to prevent access to the supply items. The first panel has a first portion and a second portion configured to be selectively coupled to one another. The method also includes coupling the first and second portions of the first panel to define a closed orientation of the first panel preventing access to the supply items. The method further involves moving the first panel to a desired position of the first portion of the first panel relative to the cabinet and securing the first portion of the first panel relative to the cabinet. The method additionally includes uncoupling the first and second portions of the first panel and moving the second portion of the first panel away from the first portion of the first panel to a desired position of the second portion of the first panel creating a first space between the first portion and the second portion of the first panel. In addition, the method includes securing the second portion of the first panel relative to the cabinet to define an open orientation of the first panel and permitting access to the supply items through the first space.

A preferred embodiment of the present invention involves a controlled access dispensing unit. The dispensing unit includes a cabinet configured to hold a plurality of supply items. An enclosure assembly is arranged to permit selective access to the supply items within the cabinet. The enclosure has a first panel comprised of a first portion and a second portion. The first portion and the second portion of the first panel are movable relative to the cabinet in a first direction. The first panel has a closed position wherein the first and second portions of the first panel are coupled to one another.

The first panel also has an open position wherein the first and second portions of the first panel are separated from one another to define a first space therebetween. The enclosure additionally includes a second panel positioned in a plane substantially parallel to, and aligned with, a plane defined by the first panel. The second panel has a first portion and a second portion. The first portion and the second portion of the second panel are movable relative to the cabinet in a second direction substantially normal to the first direction. The second panel has a closed position wherein the first and second portions of the second panel are coupled to one another. The second panel also has an open position wherein the first and second portions of the second panel are separated from one another to define a second space therebetween. An access opening is defined by the intersection of the first space and the second space and permits access to a portion of the supply items.

A preferred embodiment of the present invention involves a controlled access enclosure configured to permit selective access to a plurality of supply items within a cabinet. The enclosure includes a first panel having a first portion and a second portion. The first portion and the second portion of the first panel are movable relative to the cabinet in a first direction. The first panel has a closed position wherein the first and second portions of the first panel are coupled to one another. The first panel also has an open position wherein the first and second portions of the first panel are separated from one another to define a first space therebetween. The enclosure also includes a second panel positioned in a plane substantially parallel to, and aligned with, a plane defined by the first panel. The second panel has a first portion and a second portion. The first portion and the second portion of the second panel are movable relative to the cabinet in a second direction substantially normal to the first direction. The second panel has a closed position wherein the first and second portions of the second panel are coupled to one another. The second panel also has an open position wherein the first and second portions of the second panel are separated from one another to define a second space therebetween. An access opening is defined by the intersection of the first space and the second space and permits access to a portion of the supply items.

A further aspect of the present invention involves a controlled access dispensing unit including a storage portion and an enclosure. The storage portion has a generally open forward side and the enclosure encloses the generally open forward side. The enclosure includes a first member and a second member. The first member and the second member at least partially overlap one another. The first member is connected to a first drive member and the second member is connected to a second drive member. The first member includes a first opening and the second member includes a second opening. The first opening and the second opening are selectively moveable by the first drive member and the second drive member such than the first and second openings define an access opening having a variable size and placement.

BRIEF DESCRIPTION OF THE DRAWINGS

These and other features, aspects and advantages of the present invention are described with reference to drawings of three preferred embodiments, which are intended to illustrate, and not to limit, the present invention. The drawings comprise five figures.

FIG. 4 illustrates a preferred method of operation of the dispensing apparatus of FIG. 1 wherein the front panel and the rear panel cooperate to define a variable sized access opening.

FIG. 6 is a front view of yet another dispensing apparatus similar to that of FIGS. 1 and 5.

DETAILED DESCRIPTION OF THE PREFERRED EMBODIMENT

Figure 1:
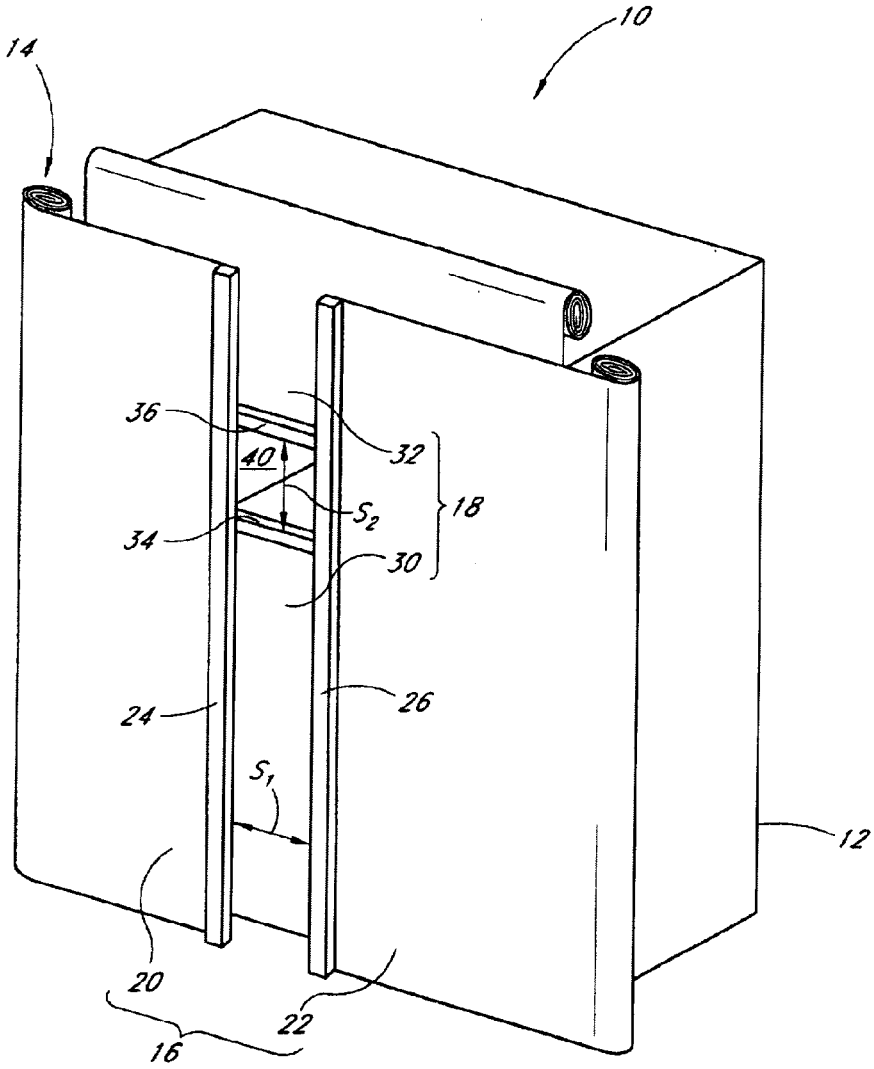
FIG. 1 is a a front, top and left side perspective view of a preferred dispensing apparatus, including a front panel and a rear panel enclosing a front side of a storage structure, or cabinet.

With reference to FIG. 1, a preferred dispensing apparatus 10 is illustrated. Desirably, the dispensing apparatus 10 includes a storage unit, such as a cabinet 12, which is configured to store a plurality of supply items, such as industrial supplies or office supplies, for example. An enclosure arrangement 14 encloses a front side of the cabinet 12 and is configured to selectively permit access to a portion of the supply items within the cabinet 12.

The cabinet 12 may take on a variety of configurations. For example, the cabinet 12 may be built specifically for use with a particular enclosure, such as the illustrated enclosure 14. The cabinet 12 may even be integrated with the enclosure 14. Alternatively, the cabinet 12 may be one of a variety of standard configurations suitable for storing objects, such as industrial or office supply items, and the enclosure 14 may be adapted for use with such a standard cabinet 12. Further, a standard storage unit, comprising a number of shelves and/or bins, may be positioned within, and secured by, the cabinet 12 and enclosure 14. Accordingly, the dispensing unit 10 may be of a stand-alone configuration or it may be a retrofit-type system wherein the enclosure 14 has been adapted for use with an existing cabinet 12. Although the word "cabinet" is used herein, one of skill in the art will appreciate that, in practice, the cabinet 12 may be of any suitable configuration to support one or more supply items, such as, for example, a shelving structure, a rack structure, a storage bin, a gravity feed storage container, or the like.

The enclosure arrangement 14 desirably comprises a first panel, or screen 16, and a second panel, or screen 18. As used herein, the first panel 16 will be called a front panel and the second panel 18 will be called a rear panel due to the relative positions in the illustrated arrangements. The terms "front" and "rear" are used for convenience only and should not be considered limiting unless specifically indicated otherwise. Desirably, the front panel 16 includes a first, or driven portion 20 and a second, or follower portion 22. As is described in greater detail below, preferably both the driven portion 20 and the follower portion 22 are configured to be movable in a horizontal direction relative to the open front face of the cabinet 12. In one arrangement, both portions 20, 22 are driven such that neither is truly a follower. Accordingly, the terms "driven" and "follower" also are used for convenience only and should not be considered limiting unless specifically indicated otherwise.

An end portion 24 of the driven portion 20 faces an end portion 26 of the follower portion 22. In the illustrated arrangement, the end portions 24, 26 are arranged to be substantially vertical. In other arrangements, however, the end portions 24, 26 can extend diagonally or they may be irregularly shaped, but mating. Other suitable arrangements may also be used, as will be appreciated by one of skill in the art.

In the illustrated embodiment, the end portions 24 and 26 are configured to be selectively coupled to one another, thereby coupling the driven portion 20 and the follower portion 22. When so coupled, the driven portion 20 and the follower portion 22 move together as a unit. In the arrangement where both portions 20, 22 are driven, the portions 20, 22 can be selectively coupled if desired, but such a coupling is not necessarily required. As illustrated in FIG. 1, the vertical ends 24, 26 of the driven portion 20 and the follower portion 22 may be selectively uncoupled such that the driven portion 20 and the follower portion 22 may be separated from one another to define a space S1 therebetween. The space S1 desirably extends substantially the entire height of the cabinet 12 and is variable in width, depending on the position of the driven portion 20 and the follower portion 22 with respect to one another.

Similarly, the rear panel 18 includes a driven portion 30 and a follower portion 32. The driven portion 30 and the follower portion 32 each include an end portion 34, 36, respectively, which are configured to be selectively connectable. In the illustrated arrangement, the end portions 34, 36 are horizontal. In other arrangements, the end portions 34, 36 can extend diagonally, can be irregularly shaped but mating, among other suitable constructions. The horizontal end portions 34, 36 of the driven portion 30 and the follower portion 32 may be uncoupled to permit relative movement, such that a space S2 may be defined between the end portions 34, 36. As illustrated, the spaces S1 and S2 overlap to define an access opening 40, which is variable in size and location with respect to the front of the cabinet 12.

Such an arrangement permits the size and location of the access opening 40 to be positioned such that access is permitted to substantially any portion of the cabinet 12. Advantageously, this permits the dispensing unit 10 to be quickly and easily programmed to accommodate various compartment arrangements within the storage portion of the cabinet 12. Accordingly, the dispenser 10 may be easily reconfigured in the field to accommodate changes in compartment arrangements that may be necessitated by changes in stocked items. Furthermore, accommodating variations in size and location of the compartments within the cabinet 12, due to such factors as manufacturing variations, for example, during initial configuration of the dispenser 10 is easily achieved. For example, in one arrangement, individual storage compartments within the cabinet 12 may be defined by a plurality of tubular members, such as PVC pipes, for example, placed within the cabinet 12 and having open ends thereof facing the generally open, forward side of the cabinet 12. With the illustrated arrangement, variations in the location and/or size of the compartment (i.e., tubular members) are easily accommodated during configuration of the dispenser 10. Such an arrangement permits cost-effective creation of a wide variety of compartment arrangements.

Desirably, the front and rear panels 16, 18 are constructed from a flexible wire mesh, or screen. In some arrangements, such a construction may provide a visual confirmation of the contents of the apparatus 10. As illustrated, the excess material of each panel portion that is not positioned in front of the cabinet 12 at any point in time desirably is maintained on a roll adjacent to each side of the open front face of the cabinet 12. Such a construction permits the enclosure arrangement 14 to be compact in size and not occupy a substantially greater area than the size of the cabinet 12, itself. The rolls preferably overlap on a rear-facing side. In one arrangement, the rolls are contained within a slotted tube. In another particularly advantageous arrangement, the excess material slides into the cabinet 12, or the walls of the cabinet 12, in a manner similar to a top on a roll-top desk. In another arrangement, the walls of the cabinet can collapse onto themselves in a manner similar to a venetian blind, for example. Alternatively, other suitable materials may be utilized depending on the degree of security desired. For example, the front and rear panels 16, 18 may be constructed of a solid material or of a material other than metal, such as a fabric or a flexible plastic material.

The front and rear panels 16, 18 may also be constructed of a rigid material, wherein the portion of the panel 16, 18 located outside of the perimeter of the front face of the cabinet 12 is not wound on a roll but, instead, simply occupies a space around the cabinet 12. The front and rear panels 16, 18 may alternatively take on other suitable arrangements for selectively preventing access to items within the cabinet 12.

Figure 2:
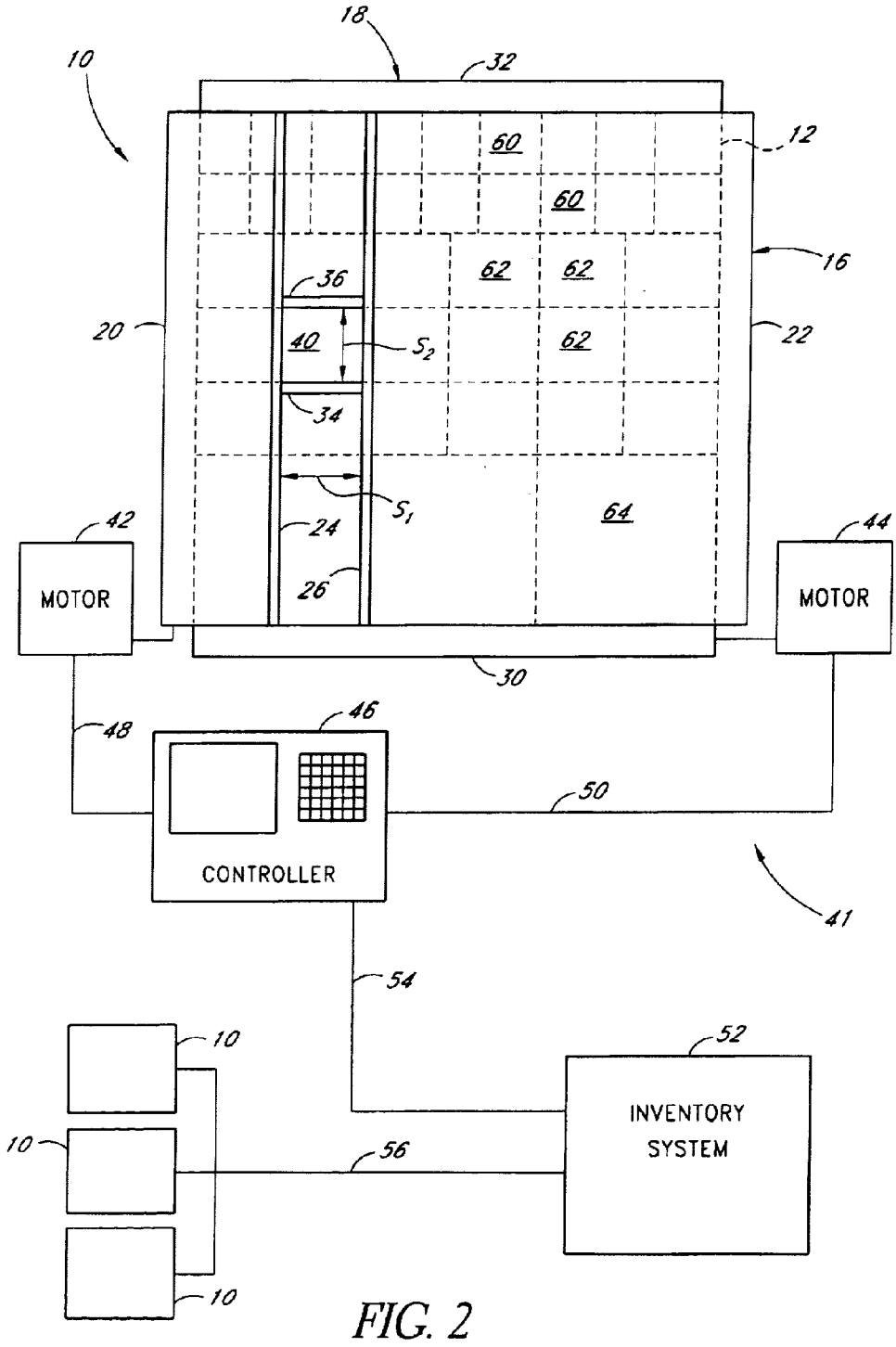
FIG. 2 is a schematic front view of the dispensing apparatus of FIG. 1, which forms a portion of an associated inventory system.

With reference to FIG. 2, the dispensing apparatus 10 is illustrated schematically as a portion of an inventory system 41. In the illustrated system 41, the front and rear panels 16, 18 are adapted to be moved in a controlled manner relative to the cabinet 12. As such, the first portions 20, 30 and the second portions 22, 32 are configured to be movable relative to one another, respectively. Desirably, a first drive member 42 is operably connected to the driven portion 20 of the front panel 16. The first drive member 42 is configured to retract or extend the driven portion 20 in a horizontal direction.

A second drive member 44 is operably connected to the driven portion 30 of the rear panel 18. The second drive member 44 is configured to extend or retract the driven portion 30 in a vertical direction, desirably in a manner similar to that of the front panel 16. Although the illustrated drive members 42, 44 preferably comprise motors, other suitable arrangements for imparting motion to the front and rear panels 16, 18 may also be used. For instance, linear actuators, solenoids, air cylinders, pneumatics and the like, can be used. In addition, the drive members 42, 44 may be connected to any suitable portion of the front and rear panels 16, 18 and any suitable type of transmission arrangement may be utilized to convert the rotational motion of the motors 42, 44 into linear motion of the panels 16, 18. Furthermore, the relative movements preferably are normal to each other, but need not be vertical and horizontal.

Desirably, a controller 46 is connected to the first drive member 42 through a first connection 48 and is connected to the second drive member 44 through a second connection 50. The controller 46 is configured to receive an input from a user of the apparatus 10 and control the first and second drive members 42, 44 in accordance with a predetermined protocol, which is described in greater detail below. Additionally, the controller 46 preferably is configured to store information regarding transactions of the dispensing apparatus 10 for use by the inventory system.

The connections 48, 50 may be of any suitable arrangement to transmit control signals between the controller 46 and the drive members 42, 44. For example, the connections 48, 50 may comprise electrical wires or RF communication connections, for example. In addition, the controller 46 and drive members 42, 44 may be an integrated unit, or may comprise a portion of a larger unit of the system.

Desirably, the controller 46 is connected to an inventory system 52 through a suitable connection 54. The inventory system 52 receives information from the controller regarding transactions that have taken place with respect to the dispensing apparatus 10. In this manner, the inventory system 52 is capable of determining the inventory level of the dispensing apparatus 10. With this information, the inventory system 52 may generate restocking orders in order to replenish the inventory within the dispensing apparatus 10.

Furthermore, the inventory system 52 may be located at the same facility as the dispensing unit 10 or, alternatively, it may be located, in whole or in part, at a supplier's facility. As illustrated, the inventory system 52 may be connected to one or more additional dispensing units 10 through an appropriate connection 56 and, similarly, may receive transaction information regarding the additional dispensing units 10. Thus, the inventory system 52 may aggregate the transactional information for each dispensing unit 10 to determine the overall inventory level of all of the dispensing units 10. In one preferred arrangement, the inventory system 52 may comprise a hosted data center in communication with the system 52 and dispensing units 10 over an internet connection. In such an arrangement, aggregate transaction processing may occur at the data center.

Desirably, the cabinet 12 of the dispensing unit 10 includes a plurality of storage spaces configured to store one or more of a particular supply item. In one arrangement, the cabinet 12 may include a plurality of small storage spaces, or compartments 60, a plurality of medium-sized storage compartments 62, and a plurality of large storage compartments 64. As will be apparent to one of skill in the art, a multitude of arrangements other than that described herein may be employed. Desirably, the size and number of the storage spaces is configured to meet the individual needs of a specific dispensing application.

In addition, the dispensing unit 10 may be arranged to determine the quantity and type of item that is removed from, or added to, the dispensing unit 10 during each transaction. Any suitable manual or automatic system for accumulating such information may be used. For example, a user may input such transactional information with an input (e.g., keypad) of the controller. Alternatively, an input (e.g., push button) may be associated with each compartment 60, 62, 64 to permit a user to manually enter the quantity of items taken from, or added to, the dispensing unit 10. In an alternative arrangement, the dispensing unit 10 may be configured to automatically determine the type and quantity of item(s) involved in any individual transaction. For example, one or more sensors (e.g. weight sensors) may be used to determine the quantity of items taken from, or added to, a specific compartment 60, 62, 64. An exemplary automatic system is explained in greater detail in U.S. patent application Ser. No. 10/008,612, filed Oct. 23, 2001 and assigned to the assignee of the present application, which application is hereby incorporated by reference in its entirety.

In the illustrated arrangement, the front and rear panels 16, 18 may cooperate to position the access opening 40 in alignment with any one of the plurality of compartments 60, 62, 64. Alternatively, the front and rear panels 16, 18 may cooperate to create an appropriately sized opening to permit access to more than one compartment 62, 62, 64, or even the entire plurality of compartments 60, 62, 64, if desired.

Figure 3:
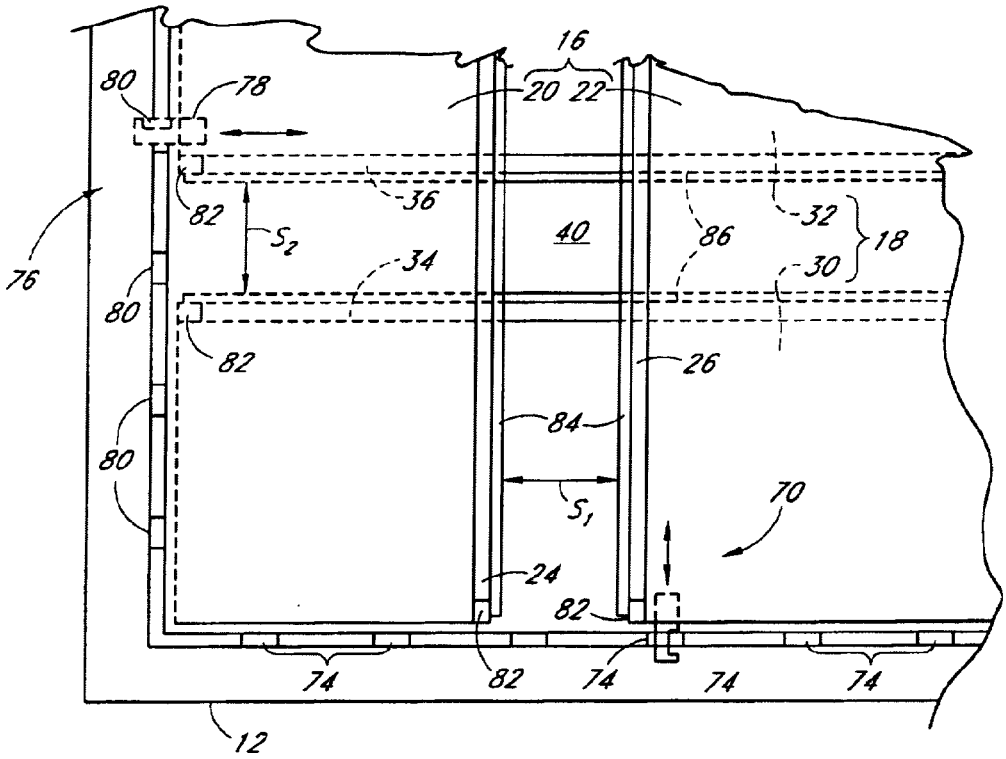
FIG. 3 is a partial front view of the dispensing apparatus of FIG. 1 illustrating a latch connection between the front and rear panels and the cabinet.

With reference to FIG. 3, desirably at least the follower portion 30 of the front panel 18 includes a latching mechanism 70 configured to selectively secure the follower portion 30 in a desired position relative to the cabinet 12. In the illustrated embodiment, a latch member 72 is movable in a vertical direction to selectively engage one of a plurality of engagement recesses 74, thereby securing the follower portion 22 in a desired position relative to the cabinet 12. Desirably, the engagement recesses 74 are positioned such that the vertical end 26 of the follower portion 22 is aligned with a desired compartment 60, 62, 64 when the latch mechanism 70 is engaged.

In the illustrated embodiment, the driven portion 20 of the front panel 16 is secured in a desired position under the control of the drive member 42. Alternatively, however, the driven portion 20 may utilize a latching mechanism similar to the latch mechanism 70 described immediately above.

Similarly, the follower portion 32 of the rear panel 18 also preferably includes a latching mechanism 76. The illustrated latching mechanism 76 includes a latch member 78 which is movable in a horizontal direction to selectively engage one of a plurality of engagement recesses 80 and is also operable to secure the follower portion 32 in a desired position relative to the cabinet 12. Similarly, the driven portion 30 of the rear panel 18 preferably utilizes the drive member 44 to secure the driven portion 30 in a desired position relative to the cabinet 12. However, a latch mechanism similar to the latch mechanism 76 described immediately above may also be utilized to secure the driven portion 30 in a desired location.

Desirably, each of the driven portions 20, 30 and the follower portions 22, 32 include a position sensor 82 configured to determine a position of the respective driven portion 20, 30 or follower portion 22, 32 relative to the cabinet 12. Desirably, the position sensors 82 are connected to the controller 46 (FIG. 2) such that the controller 46 is able to determine the position of each portion of the panels 16, 18 and position them accordingly such that the access opening has a desired location and size. In some arrangements, a stepper motor forms the drive member and the number of increments and decrements can be stored and used in place of a position sensor.

As will be readily apparent to one of skill in the art, any number of suitable arrangements may be utilized to position and hold, or lock, the individual portions of the front and rear panels 16, 18 in a desired position. For example, any suitable type of mechanical lock, or latch, arrangement may be used to secure the individual portions of the front and rear panels 16, 18 relative to the cabinet 12. Alternatively, any suitable type of electrical, electromechanical, magnetic, or other similar mechanism may be used. Further, any suitable position sensor arrangement may be utilized to determine the relative position of the individual portions of the front and rear panels 16, 18 with respect to the cabinet 12, or to one another.

In the illustrated embodiment, the vertical ends 24, 26 of the front panel 16 include a light curtain arrangement 84. Similarly, the horizontal end portions 34, 36 of the rear panel 18 also include a light curtain arrangement 86. The light curtain is generally formed by emitter and detector pairs. As is known in the art, the light curtain arrangements 84, 86 are configured to determine when an object is positioned therebetween. The light curtain arrangements 84, 86 communicate with the controllers and limit or prevent movement of the panels 16, 18 when something is extending into the opening 40. Accordingly, the light curtains 84, 86 advantageously are capable of determining when an object is positioned between the vertical end portions 24, 26 or the horizontal end portions 34, 36 and avoid closing the front or rear panels 16, 18. Any suitable type of sensor may be incorporated for such a purpose. For instance, a movement resistance sensor can be used such that any force resisting movement of the panels 16, 18 causes the panels 16, 18 to stop moving or retreat.

Figure 4A:
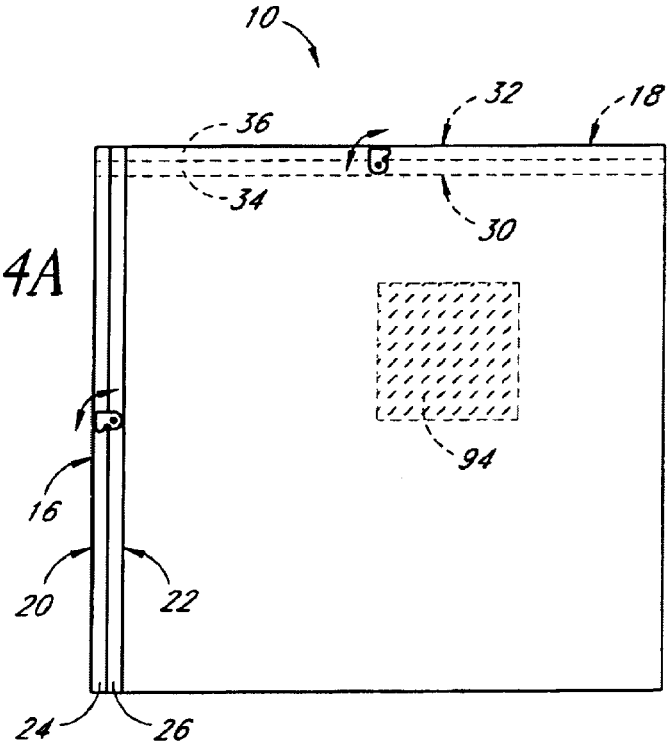
FIG. 4*a* shows the front and rear panels in a home position.

With reference to FIGS. 4*a*–4*d*, a preferred method of operation of the dispensing apparatus 10 is described in greater detail. With reference to FIG. 4*a*, the driven portion 20 and the follower portion 22 of the front panel 16 are selectively connectable such that the front panel 16 moves as a single unit. A latch mechanism 90 is operable to selectively couple or uncouple the driven portion 20 and the follower portion 22. The latch mechanism 90 may be any one of a suitable arrangement for selectively coupling the portions 20, 22 of the front panel 16.

Similarly, the driven portion 30 and the follower portion 32 of the rear panel 18 desirably includes a latch mechanism 92. The latch mechanism 92 is also configured to selectively couple the portions 30, 32 of the rear panel 18 such that the rear panel 18 is capable of moving as a single unit.

For the purpose of illustration of a preferred method of use of the dispensing apparatus 10, FIGS. 4*a*–4*d* schematically illustrate a desired compartment 94. For the purpose of clarity, the size and position of the compartment 94 is visible despite whether the front or rear panels 16, 18 are open or closed. In addition, the remainder of the compartments of the dispensing unit 10 are omitted. However, the illustrated compartment 94 may also comprise more than one individual compartment, as described above. In addition, as will be readily apparent to one of skill in the art, the compartment 94 may be located anywhere within the dispensing unit 10 and, furthermore, may be a variety of sizes.

FIG. 4*a* illustrates the front and rear panels 16, 18 in a base, or home, position. In the home position, the end portions 24, 26 are positioned substantially entirely to one side of the dispensing apparatus 10. In the illustrated embodiment, the end portions 24, 26 are positioned to the left side of the dispensing apparatus 10, as viewed from facing the front of the apparatus 10. The end portions 34, 36 of the rear panel 18 are positioned substantially to the uppermost end of the apparatus 10. Although, it is preferred to have the front and rear panels 16, 18 to return to such a home position between transactions, it is not necessary in order to practice preferred embodiments of the present dispensing system and method.

Figure 4B:
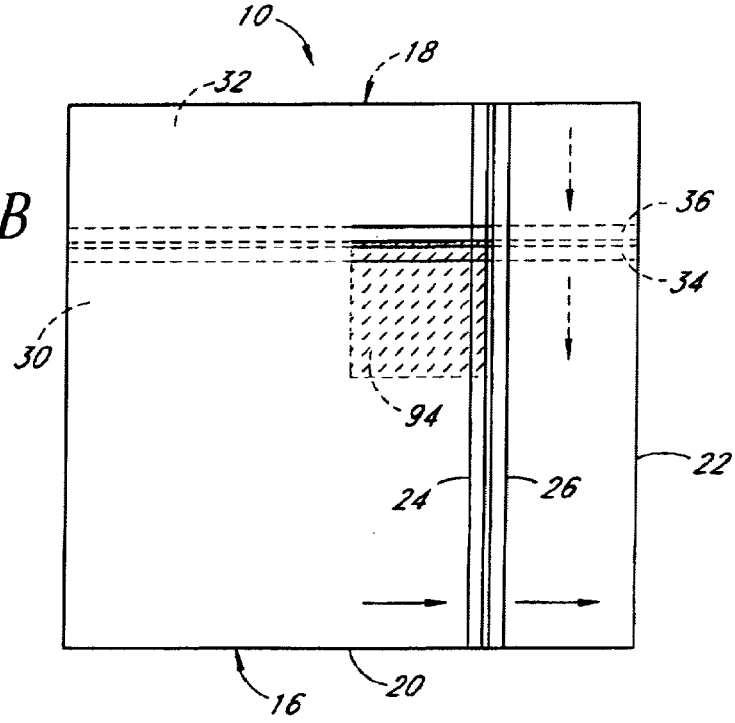
FIG. 4*b* shows the dispensing apparatus in a located position.

With reference to FIG. 4*b*, when the location and size of the desired compartment 94 has been determined, the portions 20, 22 of the front panel 16 move from the home position toward the location of the compartment 94, as indicated by the solid arrows of FIG. 4*b*. Desirably, the front panel 16 stops moving when the vertical end 26 of the follower portion 22 is positioned adjacent to the right most edge of the compartment 94.

Similarly, the rear panel 18 moves as a unit, from its home position, toward the compartment 94, as indicated by the dashed line arrows of FIG. 4*b*. In a preferred embodiment, the rear panel 18 stops moving when the horizontal end portion 36 of the follower portion 32 is aligned with the upper-most side of the compartment 94.

Figure 4C:
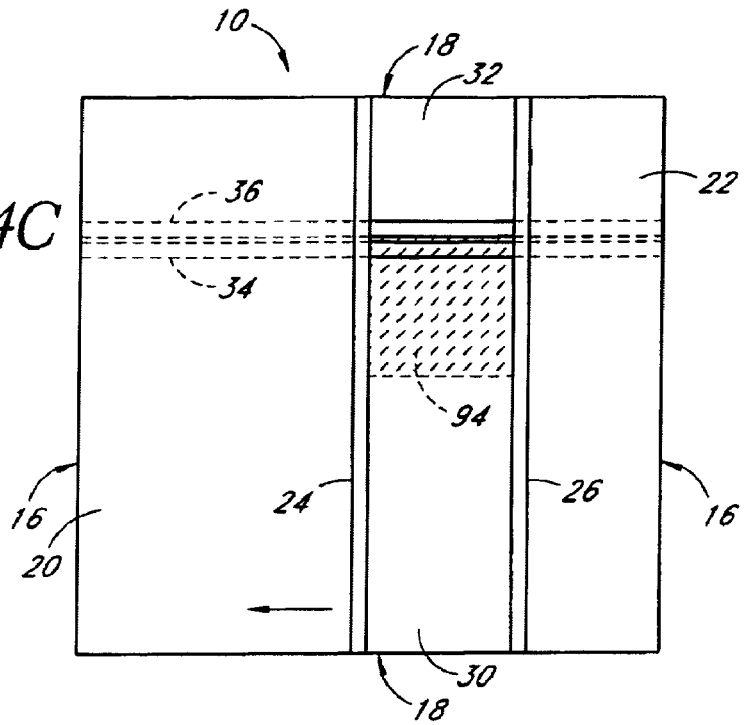
FIG. 4*c* shows the dispensing apparatus in a front panel open position.

With reference to FIG. 4*c*, desirably, once the follower portions 22, 32 have been properly positioned, the drive portion 20 and follower portion 22 of the front panel 18 are uncoupled from one another. As described above, preferably the follower portion 22 is simultaneously latched, or otherwise secured, in a position relative to the compartment 94. The drive portion 20 is then moved away from the follower portion 22 and aligned with the opposite side, or left side, of the compartment 94.

Figure 4D:
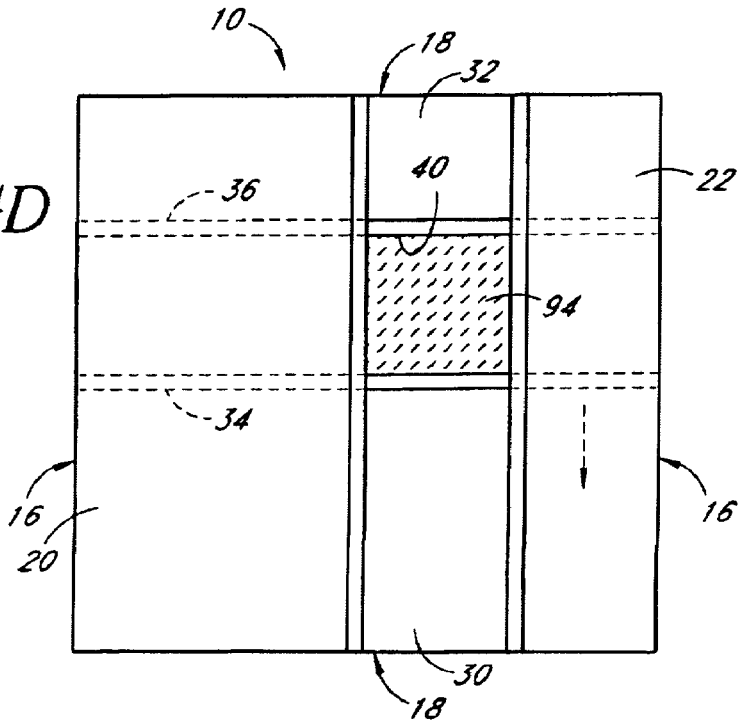
FIG. 4*d* shows the dispensing apparatus in a front panel open and rear panel open position defining an access opening.

With reference to FIG. 4*d*, once the front panel 16 has been positioned such that the driven portion 20 and the follower portion 22 are appropriately positioned on opposing sides of the compartment 94, the driven portion 30 of the rear panel 18 is then moved in a downward direction until the horizontal end portion 34 is aligned with a lowermost side of the compartment 94. Accordingly, the access opening 40 is sized and positioned such that access to the compartment 94 is permitted. In addition, desirably the access opening 40 is sized and positioned such that access to any other compartment within the dispensing unit 10 is prevented.

As will be readily determined by one of skill in the art, one or more of the steps illustrated in FIGS. 4*a*–4*d* may be accomplished simultaneously. For example, movement of the front and rear panels 16, 18 illustrated in FIG. 4*b* may occur either consecutively or simultaneously. Similarly, the movement of the driven portions 20, 30 of the front and rear panels 16, 18 illustrated in FIGS. 4*c* and 4*d* may occur either consecutively or simultaneously. In addition, the individual portions of the front and rear panels 16, 18 may be positioned in an order other than that described above. For example, the first and second portions 30, 32 of the rear panel 18 may be positioned initially followed by the first and second portions 20, 22 of the front panel 16. Preferably, in a drive and follower arrangement, the follower portion is closest to the home position when any compartment is defined. Such an arrangement reduces the number of movements and any associated wear caused thereby. Furthermore, the home positions may be centrally located to speed movement to the desired compartments on either side of the central location.

Figure 5:
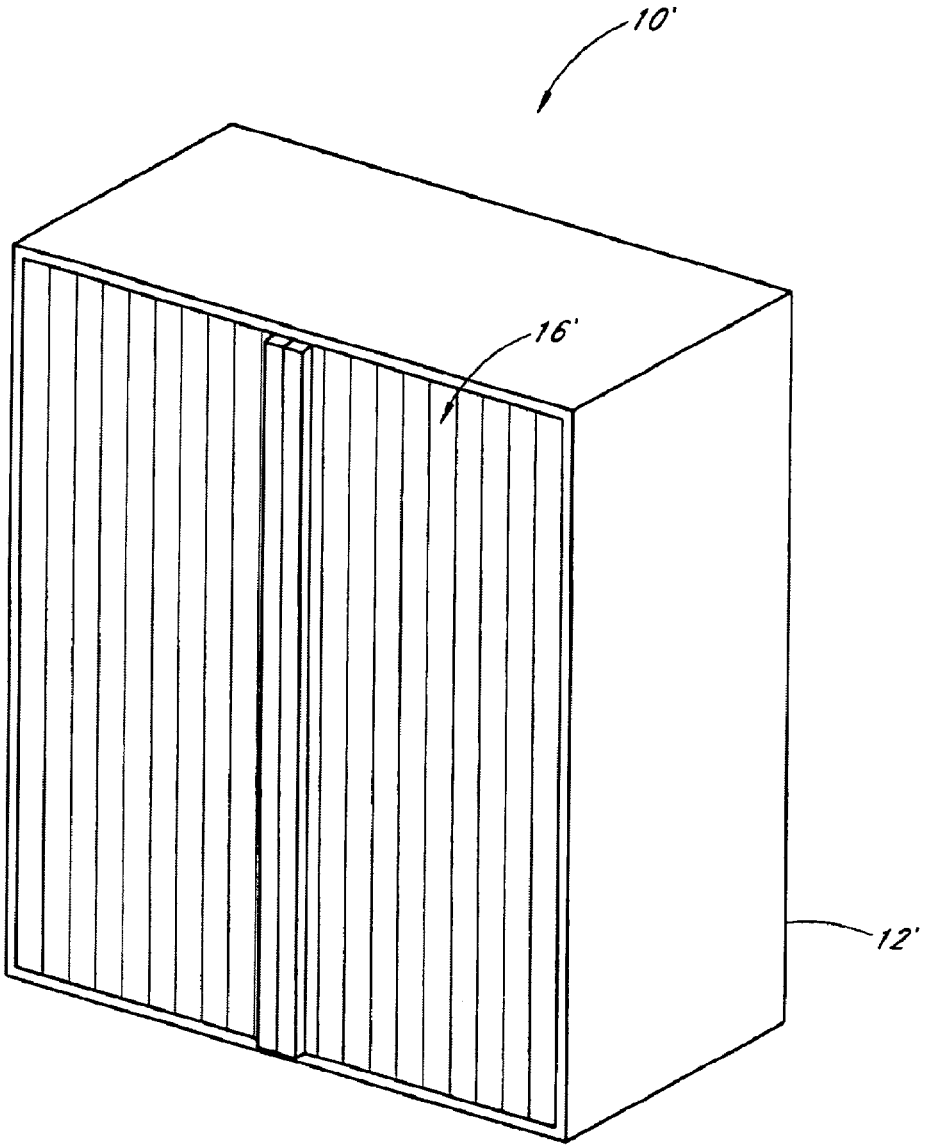
FIG. 5 is a front, top, and left side perspective view of another dispensing apparatus similar to that of FIG. 1.

FIG. 5 illustrates a modification of a dispensing apparatus 10 of FIGS. 1–4, which is referred to generally by the reference numeral 10'. The dispensing apparatus 10' of FIG. 5 operates in a similar manner to that described in relation to FIGS. 1–4 and, therefore, like reference numerals refer to like components, except that a prime (') has been added.

In the embodiment of FIG. 5, the front panel 16' is comprised of a segmented, collapsible member, in contrast to the roll-away panels 16, 18 of the dispensing apparatus 10 of FIGS. 1–4. Although not specifically shown, desirably the rear panel also comprises a segmented collapsible member. The panels preferably are comprised of a plurality of individual segments that are interconnected and capable of collapsing into substantially the width of a single segment. As mentioned above, other suitable panel arrangements may also be used.

Although the above-described embodiments are preferred, FIG. 6 illustrates a modification of a dispensing apparatus 10 of FIGS. 1–4, which is referred to generally by the reference numeral 10" and also provides many of the advantageous aspects described above. The dispensing apparatus 10' of FIG. 6 operates in a similar manner to that described in relation to FIGS. 1–4 and, therefore, like reference numerals refer to like components, except that a prime (") has been added.

Figure 6A:
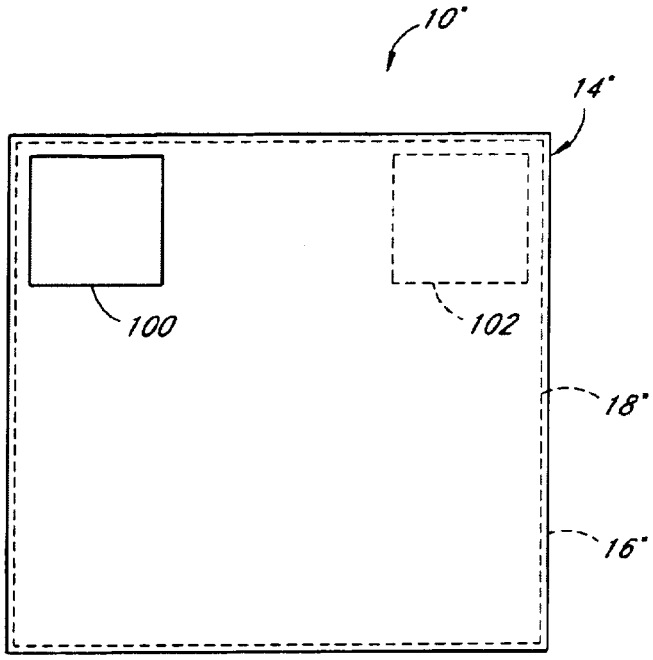
FIG. 6*a* illustrates the apparatus in a secure position and FIG. 6*b* illustrates the apparatus in an access position.
Figure 6B:
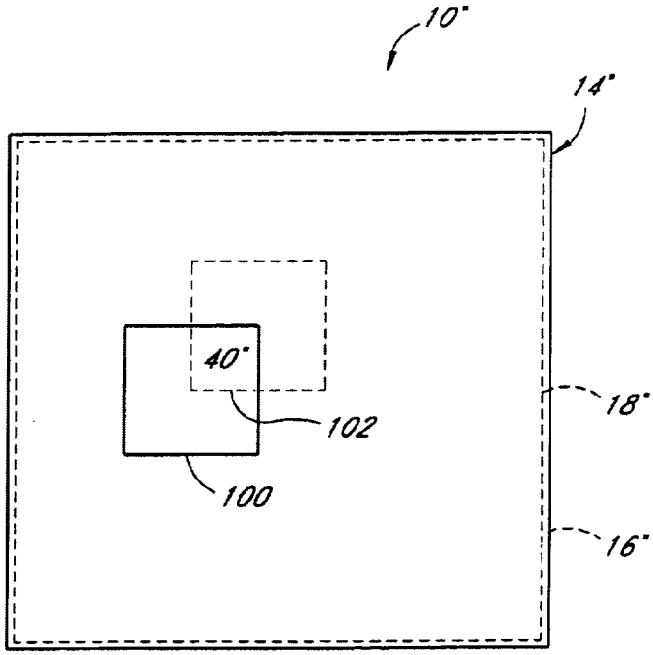

The dispensing unit 10" is illustrated schematically in FIGS. 6*a* and 6*b*, with the first panel 16" being positioned in front of the second panel 18". The second, or rear, panel 18"

is illustrated in phantom as having a slightly smaller perimeter than the first, or forward, panel 16". However, desirably both of the panels are of approximately the same dimensions and the depiction of the perimeter of the rear panel 18" being inside of the front panel 16" is merely for convenience.

Each of the front and rear panels 16", 18" include an oversized opening 100, 102, respectively. Preferably, the openings 100, 102 are of fixed dimensions and sized such that the openings 100, 102 do not overlap in at least one relative position between the front and rear panels 16", 18". Such a relative position defines a secured position of the dispensing unit 10". One example of such a secured position is illustrated in FIG. 6*a,* however, other non-overlapping relative positions of the front and rear panels 16", 18" may also be suitable as a secured, or home, position, as will be readily appreciated by one of skill in the art.

In the embodiment of FIGS. 6*a* and 6*b*, both the front and rear panels 16", 18" are movable in both a horizontal and vertical direction such that, with a combination of horizontal and vertical movement, the openings 100, 102 may be positioned in substantially any location of the front side of the dispensing unit 10". Alternatively, the panels 16", 18" may be movable in a first non-horizontal and non-vertical direction and also in a second direction substantially normal to the first direction. In other words, movement of the panels 16", 18" is not necessarily limited to horizontal and vertical directions.

As illustrated in FIG. 6*b*, the panels 16", 18" may be moved such that a portion, or all, of the opening 100 overlaps a portion, or all, of the opening 102 to define an access opening 40", which permits access to the items within the dispensing unit 10". Because the openings 100, 102 may be positioned in substantially any location of the front, access side of the unit 10", the access opening 40" may also be positioned in substantially any location of the access side of the unit 10" such that access may be selectively permitted to any portion of the items held therein.

The preferred dispensing units described herein are capable of selectively permitting access to one or more compartments of a cabinet through an access opening. Advantageously, the access opening may be quickly and easily varied in size and position to allow access to the desired compartment(s). Such an arrangement permits the dispensing unit to be configured to operate with a wide variety of cabinet and compartment configurations. In addition, the dispensing unit can be easily reconfigured, once located in the field, to conform to a change in the size, location and/or number of compartments within the cabinet. This permits the dispensing unit to adapt to changes in the cabinet configuration that results from changes in types of supply items to be stored. Further, the dispensing unit can be easily configured for use with compartments of a non-standard size.

Although the present invention has been described in the context of a preferred embodiment, it is not intended to limit the invention to the provided example. Modifications to the physical dispensing unit, hardware and software, or disclosed operational sequences that are apparent to one of skill in the art are considered to be part of the present invention. Accordingly, the invention should be defined solely by the appended claims in light of the teachings of the disclosure.

What is claimed is:

1. A controlled access dispensing unit, comprising:

a cabinet including a plurality of storage spaces sized and shaped to store a plurality of supply items, said cabinet having a substantially open side permitting access to said plurality of storage spaces;

an enclosure for enclosing said open side of said cabinet and configured to permit selective access to one or more of said storage spaces, said enclosure comprising a first panel having a first portion defining a first end surface generally aligned with a first axis and a second portion defining a second end surface generally aligned with said first axis and facing said first surface, said first and second portions of said first panel having a closed position relative to one another for preventing access to said plurality of storage spaces wherein said first portion of said first panel is coupled to said second portion of said first panel, said first and second portions of said first panel being movable relative to said cabinet in said closed position along a second axis substantially normal to said first axis, said first and second portions of said first panel being movable relative to one another to an open position for permitting access to one or more of said plurality of storage spaces wherein said first portion of said first panel is uncoupled with said second portion of said first panel, said first and second end surfaces of said first panel being separated from one another in said open position to define a first space therebetween;

a latch arrangement configured to secure at least one of said first portion and said second portion of said first panel in a desired position relative to said cabinet;

wherein said first panel is disposed generally in a first plane, said dispensing unit additionally comprising a second panel disposed generally in a second plane parallel to and aligned with said first plane, the second panel configured to selectively prevent access to said supply items through said first space, said second panel having a first portion defining a first end surface generally aligned with said second axis and a second portion defining a second end surface generally aligned with said second axis and facing said first end surface, said first and second portions of said second panel having a closed position relative to one another for preventing access to said plurality of storage spaces wherein said first portion of said second panel is coupled to said second portion of said second panel, said first and second portions of said second panel being movable relative to said cabinet in said closed position along said first axis, said first and second portions of said second panel being movable relative to one another to an open position wherein said first portion of said second panel is uncoupled with said second portion of said second panel, said first and second end surfaces of said second panel being separated from one another in said open position to define a second space therebetween, said first space and said second space cooperating to define an access opening configured to permit access to at least one of said plurality of storage spaces.

2. The dispensing unit of claim 1, additionally comprising a first motor configured to drive at least one of said first portion and said second portion of said first panel.

3. The dispensing unit of claim 2, additionally comprising a second latch arrangement configured to secure at least one of said first portion and said second portion of said second panel in a desired position relative to said cabinet.

4. The dispensing unit of claim 3, additionally comprising a first sensor arrangement configured to determine if an object is positioned between said first and second end surfaces of said first panel and preventing movement of said first and second portions of said first panel if an object is present.

5. The dispensing unit of claim 4, additionally comprising a second motor configured to drive at least one of said first portion and said second portion of said second panel.

6. The dispensing unit of claim 4, additionally comprising a second sensor arrangement configured to determine if an object is positioned between said first and second end surfaces of said second panel and preventing movement of said first and second portions of said second panel if an object is present.

7. The dispensing unit of claim 4, wherein each of said first and second panels comprise a wire mesh material.

8. The dispensing unit of claim 4, wherein each of said first and second panels comprise a segmented collapsible panel.

9. A method of controlled dispensing of supply items, comprising:

providing supply items within a cabinet;

providing a first panel configured to prevent access to said supply items, said first panel comprising a first portion and a second portion configured to be selectively coupled to one another;

coupling said first and second portions of said first panel to define a closed orientation of said first panel preventing access to said supply items;

moving said first panel to a desired position of said first portion of said first panel relative to said cabinet;

securing said first portion of said first panel relative to said cabinet;

uncoupling said first and second portions of said first panel and moving said second portion of said first panel away from said first portion of said first panel to a desired position of said second portion of said first panel creating a first space between said first portion and said second portion of said first panel;

securing said second portion of said first panel relative to said cabinet to define an open orientation of said first panel;

permitting access to said supply items through said first space;

additionally comprising providing a second panel in a plane substantially parallel to and aligned with said first panel, said second panel configured to selectively prevent access to said supply items through said first space, said second panel comprising a first portion and a second portion configured to be coupled to one another;

coupling said first and second portions of said second panel to define a closed orientation of said second panel to prevent access to said supply items through said first space;

moving said second panel to a desired position of said first portion of said second panel relative to said cabinet;

securing said first portion of said second panel relative to said cabinet;

uncoupling said first and second portions of said second panel and moving said second portion of said second panel away from said first portion of said second panel to a desired position of said second portion of said second panel creating a second space between said first portion and said second portion of said second panel;

securing said second portion of said second panel relative to said cabinet to define an open orientation of said second panel;

permitting access to a portion of said supply items through an access opening defined by an intersection of said first space and said second space.

10. The method of claim 9, additionally comprising providing said supply items within a plurality of compartments within said cabinet, wherein said desired position of said first portion of said second panel is aligned with a first side of one of said plurality of compartments, wherein further said desired position of said second portion of said second panel is aligned with a second side of said one of said plurality of compartments opposite said first side.

11. The method of claim 9, additionally comprising sensing if an object is positioned within said access opening and preventing movement of said first and second portions of said first panel and said first and second portions of said second panel if an object is positioned within said access opening.

12. The method of claim 9, additionally comprising utilizing a user input signal to determine said desired positions of said first and second portions of said first panel and said desired positions of said first and second portions of said second panel.

13. A controlled access dispensing unit, comprising:

a cabinet configured to hold a plurality of supply items;

an enclosure assembly configured to permit selective access to said supply items within said cabinet, said enclosure comprising a first panel having a first portion and a second portion, said first portion and said second portion of said first panel being movable relative to said cabinet in a first direction, said first panel having a closed position wherein said first and second portions of said first panel are coupled to one another, said first panel having an open position wherein said first and second portions of said first panel are separated from one another to define a first space therebetween, said enclosure additionally comprising a second panel positioned in a plane substantially parallel to and aligned with a plane defined by said first panel, said second panel having a first portion and a second portion, said first portion and said second portion of said second panel being movable relative to said cabinet in a second direction substantially normal to said first direction, said second panel having a closed position wherein said first and second portions of said second panel are coupled to one another, said second panel having an open position wherein said first and second portions of said second panel are separated from one another to define a second space therebetween;

wherein an access opening is defined by the intersection of said first space and said second space, said access opening permitting access to a portion of said supply items;

a first latch arrangement configured to secure at least one of said first portion and said second portion of said first panel in a desired position relative to said cabinet and a second latch arrangement configured to secure at least one of said first portion and said second portion of said second panel in a desired position relative to said cabinet.

14. The dispensing unit of claim 13, additionally comprising a first motor configured to drive at least one of said first portion and said second portion of said first panel.

15. The dispensing unit of claim 14, additionally comprising a second motor configured to drive at least one of said first portion and said second portion of said second panel.

16. The dispensing unit of claim 13, additionally comprising a sensor arrangement configured to determine if an object is positioned within said access opening and preventing movement of said first and second portions of said first panel if an object is positioned within said access opening.

17. A dispensing unit, comprising:

a cabinet configured to store a plurality of supply items;

a first panel having a first portion and a second portion, said first portion and said second portion of said first panel being movable relative to said cabinet in a first direction, said first panel having a closed position wherein said first and second portions of said first panel are coupled to one another, said first panel having an open position wherein said first and second portions of said first panel are separated from one another to define a first space therebetween;

a second panel positioned in a plane substantially parallel to and aligned with a plane defined by said first panel, said second panel having a first portion and a second portion, said first portion and said second portion of said second panel being movable relative to said cabinet in a second direction substantially normal to said first direction, said second panel having a closed position wherein said first and second portions of said second panel are coupled to one another, said second panel having an open position wherein said first and second portions of said second panel are separated from one another to define a second space therebetween;

wherein an access opening is defined by the intersection of said first space and said second space, said access opening permitting access past said enclosure to a portion of said supply items within said cabinet;

a first latch arrangement configured to secure at least one of said first portion and said second portion of said first panel in a desired position relative to said cabinet and a second latch arrangement configured to secure at least one of said first portion and said second portion of said second panel in a desired position relative to said cabinet.

18. The dispensing unit of claim 17, additionally comprising a first motor configured to drive at least one of said first portion and said second portion of said first panel.

19. The dispensing unit of claim 18, additionally comprising a second motor configured to drive at least one of said first portion and said second portion of said second panel.

20. The dispensing unit of claim 17, additionally comprising a sensor arrangement configured to determine if an object is positioned within said access opening and preventing movement of said first and second portions of said first panel if an object is positioned within said access opening.

21. A controlled access dispensing unit comprising a storage portion and an enclosure, said storage portion having a generally open forward side, said enclosure enclosing said generally open forward side, said enclosure comprising a first member and a second member, said first member and said second member at least partially overlapping, said first member being connected to a first drive member and said second member being connected to a second drive member, said first member comprising a first opening having a fixed size and said second member comprising a second opening having a fixed size, said first opening and said second opening being selectively moveable by said first drive member and said second drive member such that at least a portion of said first and second openings coincide to define an access opening having a variable size and placement.

* * * * *